US009394654B2

(12) United States Patent
Perkins, Jr.

(10) Patent No.: US 9,394,654 B2
(45) Date of Patent: Jul. 19, 2016

(54) TRACK DRIVEN SLAB SAW

(71) Applicant: David L. Perkins, Jr., Fort Wayne, IN (US)

(72) Inventor: David L. Perkins, Jr., Fort Wayne, IN (US)

( * ) Notice: Subject to any disclaimer, the term of this patent is extended or adjusted under 35 U.S.C. 154(b) by 0 days.

(21) Appl. No.: 13/952,147

(22) Filed: Jul. 26, 2013

(65) Prior Publication Data

US 2014/0028077 A1 Jan. 30, 2014

Related U.S. Application Data

(60) Provisional application No. 61/676,512, filed on Jul. 27, 2012.

(51) Int. Cl.
*E01C 23/09* (2006.01)
*B28D 1/04* (2006.01)
*E21C 25/16* (2006.01)

(52) U.S. Cl.
CPC ..... *E01C 23/0933* (2013.01); *B28D 1/045* (2013.01); *E21C 25/16* (2013.01)

(58) Field of Classification Search
CPC ..... E01C 23/0933
USPC ..... 299/39.3; 404/85, 87, 89; 125/13.03
See application file for complete search history.

(56) References Cited

U.S. PATENT DOCUMENTS

| | | | | |
|---|---|---|---|---|
| 2,052,068 | A | 8/1936 | Ziegler | |
| 3,663,063 | A | 5/1972 | Johnmeyer, Sr. | |
| 4,043,601 | A | 8/1977 | Schiller | |
| 4,310,198 | A | 1/1982 | Destree | |
| 4,608,477 | A * | 8/1986 | Deichelbohrer | 219/69.2 |
| 4,662,684 | A * | 5/1987 | Marten | 299/1.5 |
| 4,755,004 | A | 7/1988 | Palmquist et al. | |
| 5,215,071 | A | 6/1993 | Mertes et al. | |
| 5,575,538 | A | 11/1996 | Gilbert et al. | |
| 5,785,453 | A * | 7/1998 | Marty et al. | 404/94 |
| 5,950,612 | A * | 9/1999 | Zuzelo et al. | 125/13.01 |
| 6,470,874 | B1 * | 10/2002 | Mertes | 125/12 |
| 6,536,422 | B1 | 3/2003 | Zuzelo et al. | |
| 6,547,337 | B2 | 4/2003 | Welch, Jr. | |
| 6,990,972 | B2 | 1/2006 | Markley | |
| 7,073,495 | B1 * | 7/2006 | Markley | 125/13.01 |
| 7,669,589 | B2 | 3/2010 | Kingsley et al. | |
| 7,942,604 | B2 * | 5/2011 | Willis et al. | 404/84.05 |
| 2006/0219079 | A1 | 10/2006 | Zhang | |
| 2006/0219232 | A1 * | 10/2006 | Zhang | 125/13.01 |
| 2010/0018514 | A1 * | 1/2010 | Wills, II | 125/13.01 |
| 2010/0120578 | A1 * | 5/2010 | Bouguerra et al. | 477/1 |
| 2011/0016754 | A1 * | 1/2011 | Ruhl et al. | 37/94 |
| 2011/0037307 | A1 * | 2/2011 | Bollinger | 299/18 |

OTHER PUBLICATIONS

Target; Operating Instructions—Parts List for PRO 65 II—Concrete/Asphalt Saw; Dec. 1993.

Diamond Products; Master Product Catalog; Jan. 5, 2012; pp. 114-157.

* cited by examiner

*Primary Examiner* — David Bagnell
*Assistant Examiner* — Michael Goodwin
(74) *Attorney, Agent, or Firm* — Barnes & Thornburg LLP

(57) ABSTRACT

A slab saw including a frame, an engine supported by the frame, an arbor, and first and second tracks disposed along opposing sides of the frame. The arbor may be configured to be rotated by the engine. The first track and the second track may be configured to propel the frame. A drive assembly may be configured to independently drive the first track with respect to the second track to propel the slab saw. A control assembly may be configured to control the drive assembly as to a speed and direction of the slab saw.

23 Claims, 19 Drawing Sheets

TRACK DRIVEN SLAB SAW

RELATED APPLICATIONS

This application claims the benefit of U.S. Provisional Application Ser. No. 61/676,512 filed Jul. 27, 2012, for a "Track Driven Concrete Slab Saw," which is hereby incorporated by reference in its entirety.

TECHNICAL FIELD

The present invention generally relates to devices for cutting a material; in particular, the invention relates to a slab saw for cutting concrete, asphalt, and other materials.

BACKGROUND

There are many different types of machines used to make cuts in previously formed and hardened concrete and asphalt. For example, slab saws make generally vertically-oriented cuts and can be used for a variety of purposes, such as cutting trenches in concrete for laying pipe and/or cables, renovation projects in which a worn or broken surface may need modification and/or replacement, and other projects in which a concrete or asphalt surface needs to be cut.

Self-propelled slab saws are well known. FIGS. 1 and 2 show diagrammatical side views of an existing self-propelled slab saw 1. The saw 1 includes a saw blade 2 that could be mounted on either a right arbor or left arbor for cutting concrete and/or asphalt or other surface. An engine 3 operates the saw blade 2 and could be used to drive one or more of the wheels 4. The operator walks behind the saw 1 and controls the saw's forward/backward direction and speed using a lever 5. Typically two handles 6 extend from the saw 1 to allow the operator to manually maneuver the saw 1.

With the saw blade 2 raised above the concrete as shown in FIG. 1, the operator will need to maneuver the saw 1 to the cut site and manually align the saw blade 2 with the intended cut path using the handles 6 and lower the blade 2 as shown in FIG. 2. The operator will then engage the drive wheels 4 using the lever 5 to drive the saw 1 forward along the cutting path. One issue that arises during operation is keeping the saw blade aligned with the cutting path. The operator will generally attempt to cut along a straight path. Typically, the operator will need to manually adjust the saw blade by exerting force on the handles 6 to steer the blade 2 back on course. This requires a certain amount of physical strength to maneuver the heavy saw and tends to cause injuries due to overexertion of the operator. When the saw cut is finished, the blade 2 is moved to the next cut site by maneuvering the saw 1 using the handles 6.

Another issue that arises is difficulty in moving the slab saw to the work site and/or propelling the drive wheels over certain surfaces. For example, it is difficult to move the heavy slab saw across a dirt path to the work site because the wheels tend to sink into the dirt. Irregular surfaces also create difficulties in moving the saw to the work site. For example, the wheels of a typical slab saw will have difficulty being propelled over a gravel path. If the surface is slick, the drive wheels 4 will tend to slip and not propel the saw. A surface containing holes, such a potholes or a trench for laying pipe, can also pose difficulties for the slab saw to traverse.

SUMMARY

According to one aspect, the invention provides a slab saw for cutting concrete, asphalt and other materials. Unlike existing slab saws, one embodiment of the invention provides a self-propelled saw having a control assembly that allows the saw to be steered left or right during operation. This increased maneuverability of the saw reduces (or eliminates) the need for the operator to apply physical force on the saw to maintain a position of the blade along a cutting path. For example, embodiments are contemplated in which the saw could be propelled by a left track and a right track that can be independently controlled. In such an embodiment, a differential between the speed and/or direction in which left and right tracks are driven could be used to turn the saw in either direction. A track-driven saw has other benefits, such as crossing large gaps or trenches and possibly driving in dirt, mud, rough surfaces and other possibly soft surfaces to get to a desired location. Likewise, a track-driven saw could be driven to a jobsite where the surface (e.g., concrete) is badly broken where wheeled saws could not go. Additionally, a slick surface would likely not deter traction of a track-driven saw. In another embodiment, the track-driven saw could be drive remotely using wireless communications, such as with a RF receiver and transmitter.

In many cases, embodiments of this invention provide safety advantages. For example, loading and unloading the saw is less likely to cause injuries. Additionally, due to the track-driven nature of the saw in some embodiments, the device tends to be more stable because weights and balances are not as much of a factor. Additionally, embodiments of the saw are less likely to tip because weight distribution is not needed to allow the back portion to be lifted by an operator and therefore balance is not as much of an issue.

According to another aspect, this disclosure provides a slab saw comprising a frame, an engine supported by the frame, an arbor, and first and second tracks disposed along opposing sides of the frame. The arbor may be configured to be rotated by the engine. The first track and the second track may be configured to propel the frame. A drive assembly may be configured to independently drive the first track with respect to the second track to propel the slab saw. A control assembly may be configured to control the drive assembly as to a speed and direction of the slab saw.

According to a further aspect, this disclosure provides a slab saw comprising a frame, an engine supported by the frame, an arbor, and first and second tracks disposed along opposing sides of the frame. The arbor may be configured to be rotated by the engine. The first track and the second track may be configured to propel the frame. The slab saw may include means for independently driving the first track with respect to the second track; and means for steering the slab saw by applying a speed differential between the first track and the second track.

According to yet a further aspect, this disclosure provides a method for operating a slab saw. This method includes the steps of: providing a track-driven slab saw having a first track and a second track; independently driving the first track with respect to the second track to propel the slab saw; the first track and the second track being disposed along opposite sides of the slab saw; and steering the slab saw by applying a speed differential between the first and second tracks.

Other embodiments are contemplated in which the drive assembly may include a left and right set of wheels that could be independently controlled—similar to a skid steer. As with the track driven embodiment, the left and right set of wheels could be driven at different speeds to turn the saw in a desired direction.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 1:
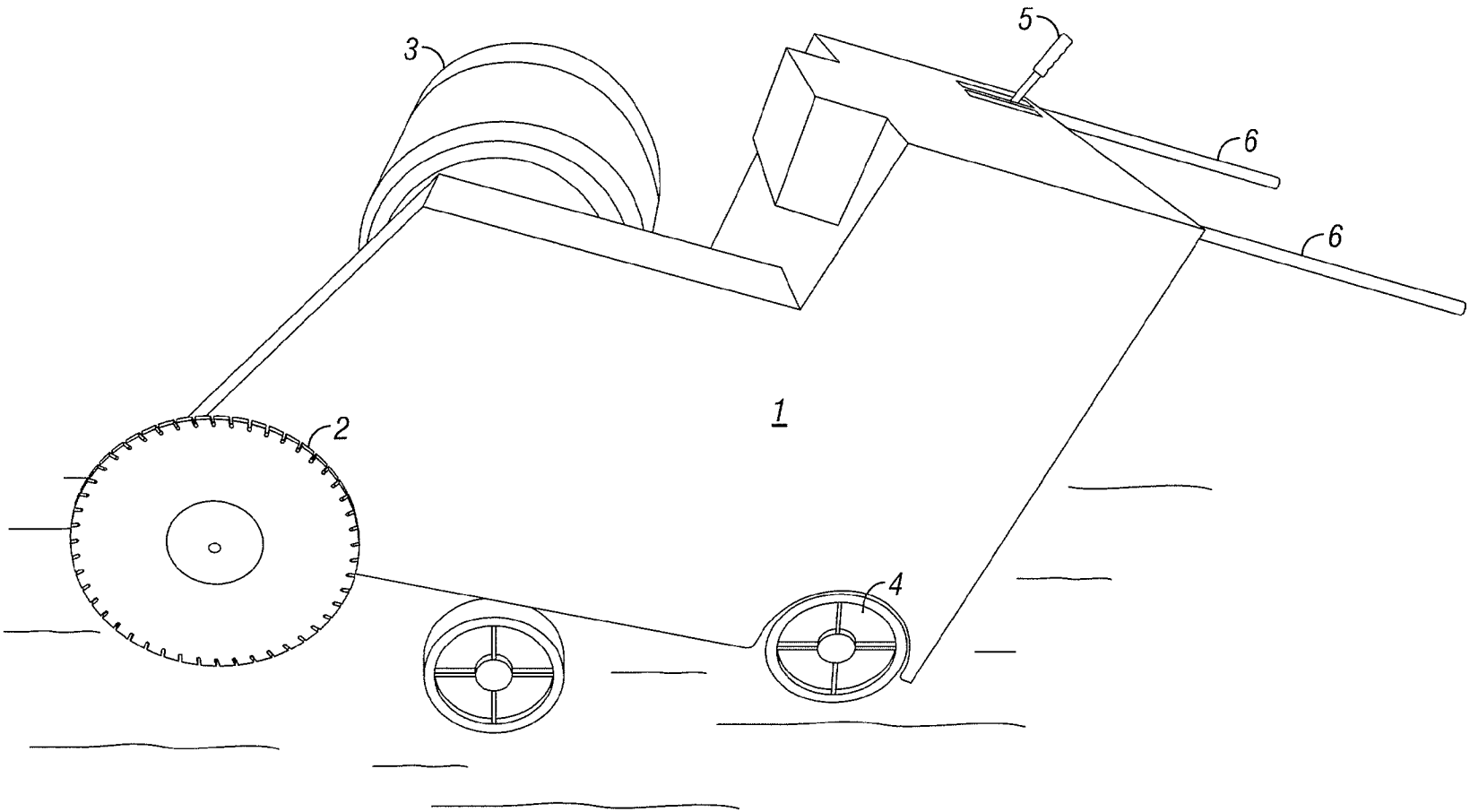
FIG. 1 (Prior Art)
FIG. 1 is an example prior art slab saw with the saw blade in the raised position.
Figure 2:
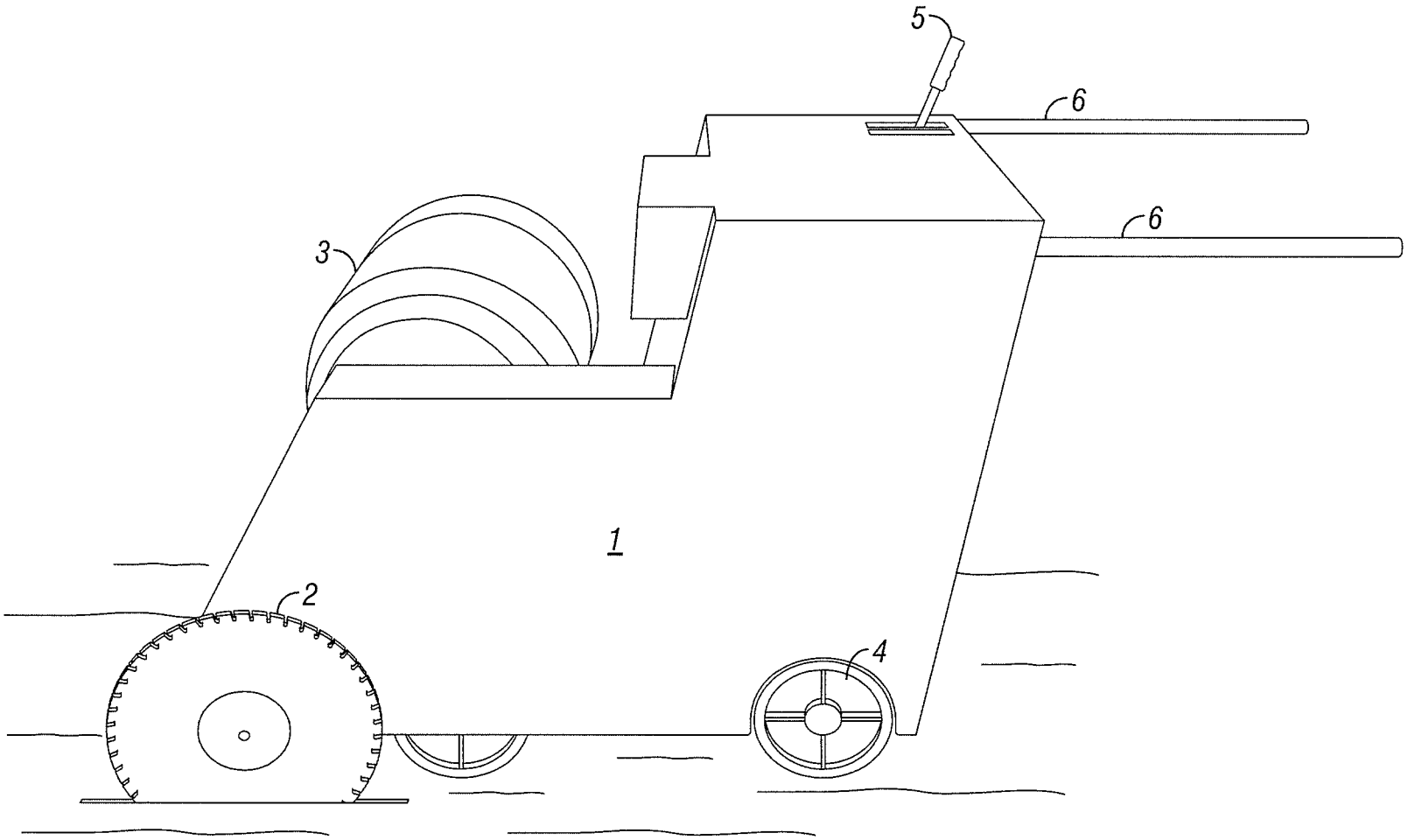
FIG. 2 (Prior Art)
FIG. 2 is the example prior art slab saw with the saw blade in the lowered or cutting position.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

Figure 3A:
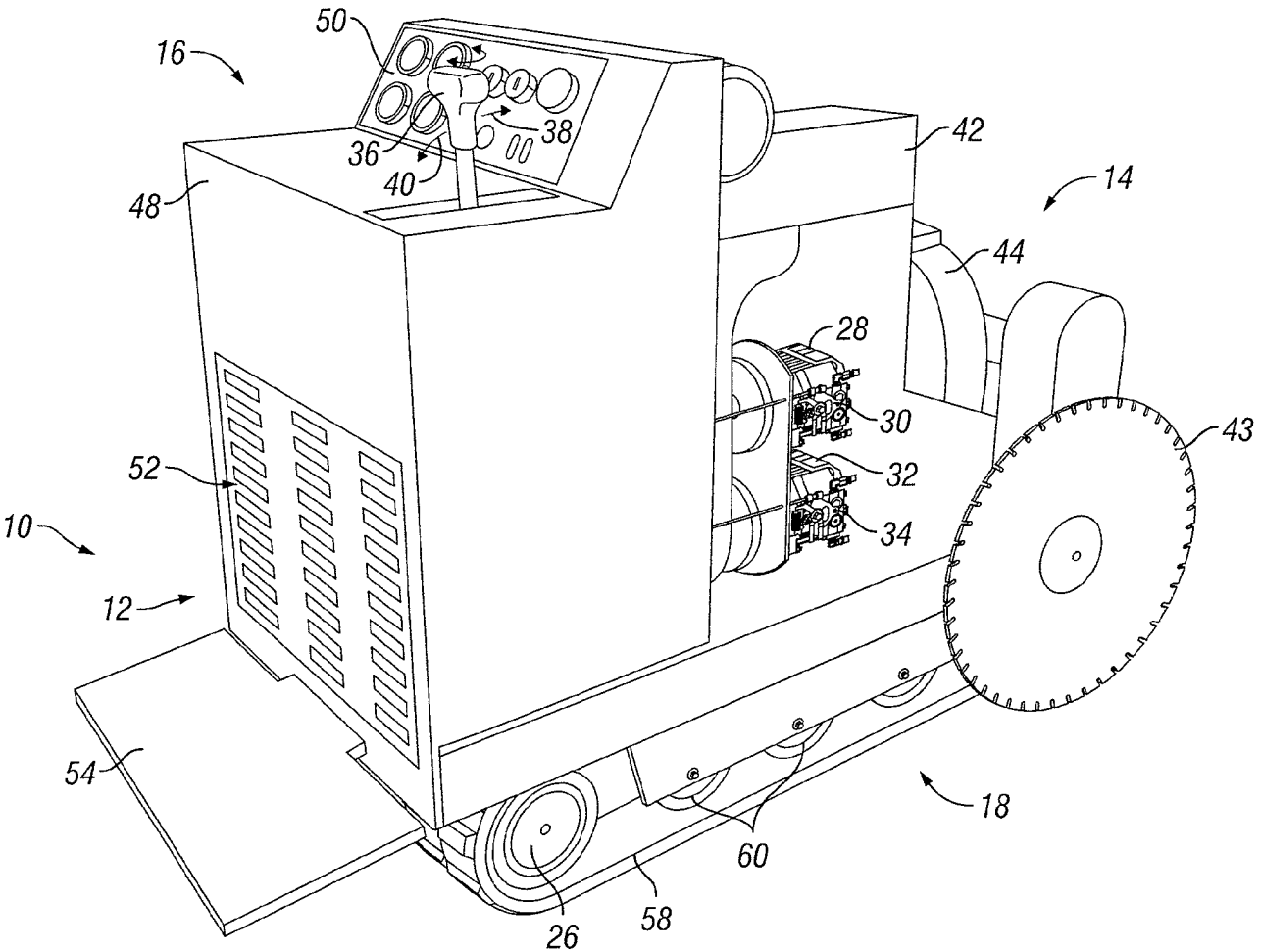
FIG. 3A is a right side perspective view of an example slab saw according to an embodiment of the present invention.
Figure 3B:
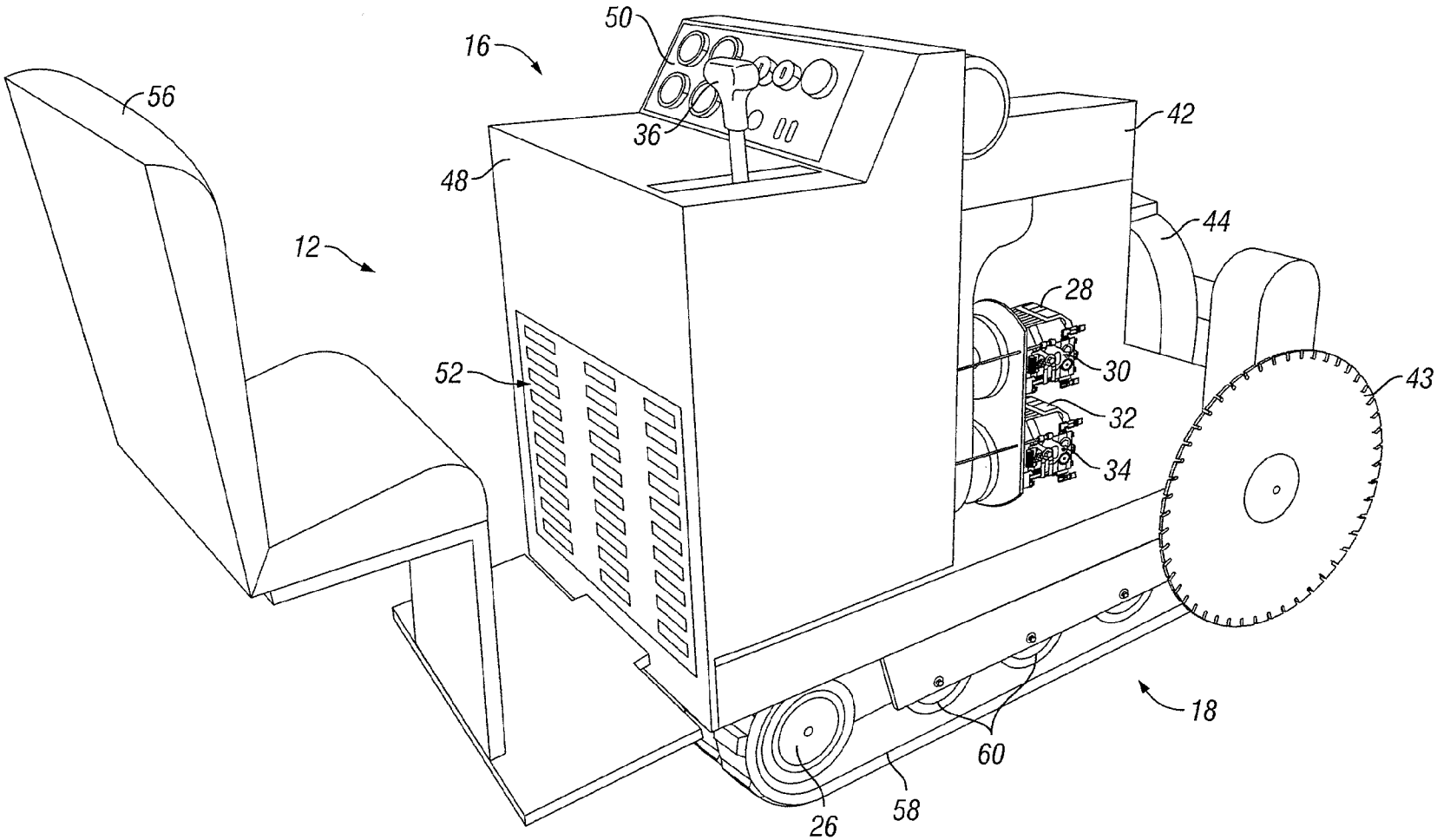
FIG. 3B is the example slab saw shown in FIG. 3B, except with a seat for the operator to sit instead of a platform for the operator to stand.

FIGS. 3A and 3B are right side perspective views of an example slab saw 10 according to an embodiment of the invention. In the example shown, the saw 10 has a rear 12, a front 14, a left side 16, and a right side 18. In this embodiment, the saw 10 includes a first track 20 and a second track 22 on which the other components are carried. The tracks 20, 22 may be used to propel and maneuver the saw 10.

As explained in more detailed below, an embodiment is contemplated in which the slab saw includes a drive assembly configured to independently drive the tracks 20, 22 to steer the saw 10 towards the left or right as desired. In one embodiment, for example, the drive assembly includes a first hydraulic motor 24 for driving the first track 20 and the second track 22 may be independently driven by a second hydraulic motor 26. As shown, the first hydraulic motor 24 is controlled by a first hydrostatic pump 28 using a first valve assembly 30 and the second hydraulic motor 26 is controlled by a second hydrostatic pump 32 with a second valve assembly 34. Although this example shows the use of hydrostatic pumps, embodiments are contemplated in which hydraulic pumps could be used. Additionally, embodiments are contemplated in which the treads could be driven by electric motor in combination with a speed control circuit. Other mechanisms for driving the tracks could be provided as should be appreciated by one skilled in the art.

In one embodiment, a control assembly with a lever 36 may be used by the operator to control the speed and steer the direction in which the saw 10 is propelled. For example, the lever 36 may increase the speed in which the saw 10 is propelled the further that the lever 36 is moved in the direction of arrow 38. Likewise, the lever 36 may be used to reverse the direction of the saw and be propelled towards the rear 12 if the operator moves the lever 36 in the direction of arrow 40. If the lever 36 is twisted in a clockwise direction in this embodiment, the saw 10 turns toward the right side 18. Conversely, if the lever 36 is twisted in the counter-clockwise direction in this embodiment, the saw 10 turns toward the left side 16. This allows the saw 10 to be moved not only in forward and reverse directions, but also steered either left or right. Although the embodiment shown uses a single lever 36 to control both speed and steering of the saw 10, other embodiments are contemplated that could use separate devices to control speed and steering. For example, a steering device, such as a steering wheel, could be used to steer the saw 10 and a speed control device could be used to separately control the speed in which the saw 10 is propelled.

In one embodiment, the lever 36 may be used to control the position of the first and second valve assemblies 30, 34 to control the direction and speed with which the tracks 20, 22 are driven. For example, a differential in the valve positions between the pumps 28, 32 could be used to steer the saw 10. With this arrangement, for example, the first motor 28 may be configured to independently drive the first track 20 and the second motor 32 could be independently configured to drive the second track 22.

In the example shown, the saw 10 includes an engine 42 (shown diagrammatically) that may be used to drive the hydrostatic pumps 28, 32 and a saw blade 43. Although the saw blade 43 is mounted on a right arbor in this example, the saw blade 43 could be mounted on the left arbor. A blade guard (not shown) may be provided for purposes of safety.

Figure 4A:
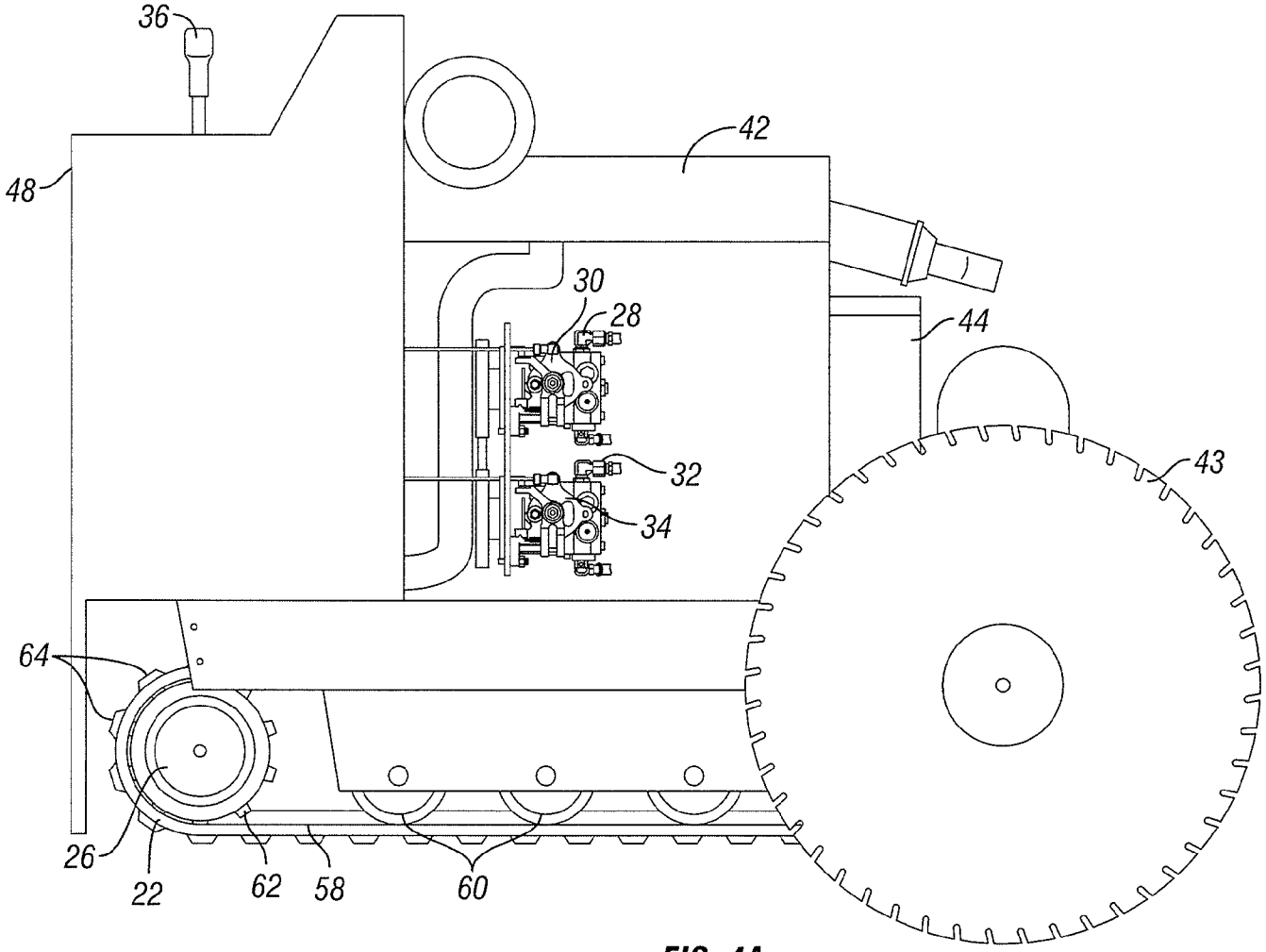
FIGS. 4A and 4B are right side views of an example slab saw according to an embodiment of the present invention with the saw in a normal and lifted position, respectively.
Figure 4B:
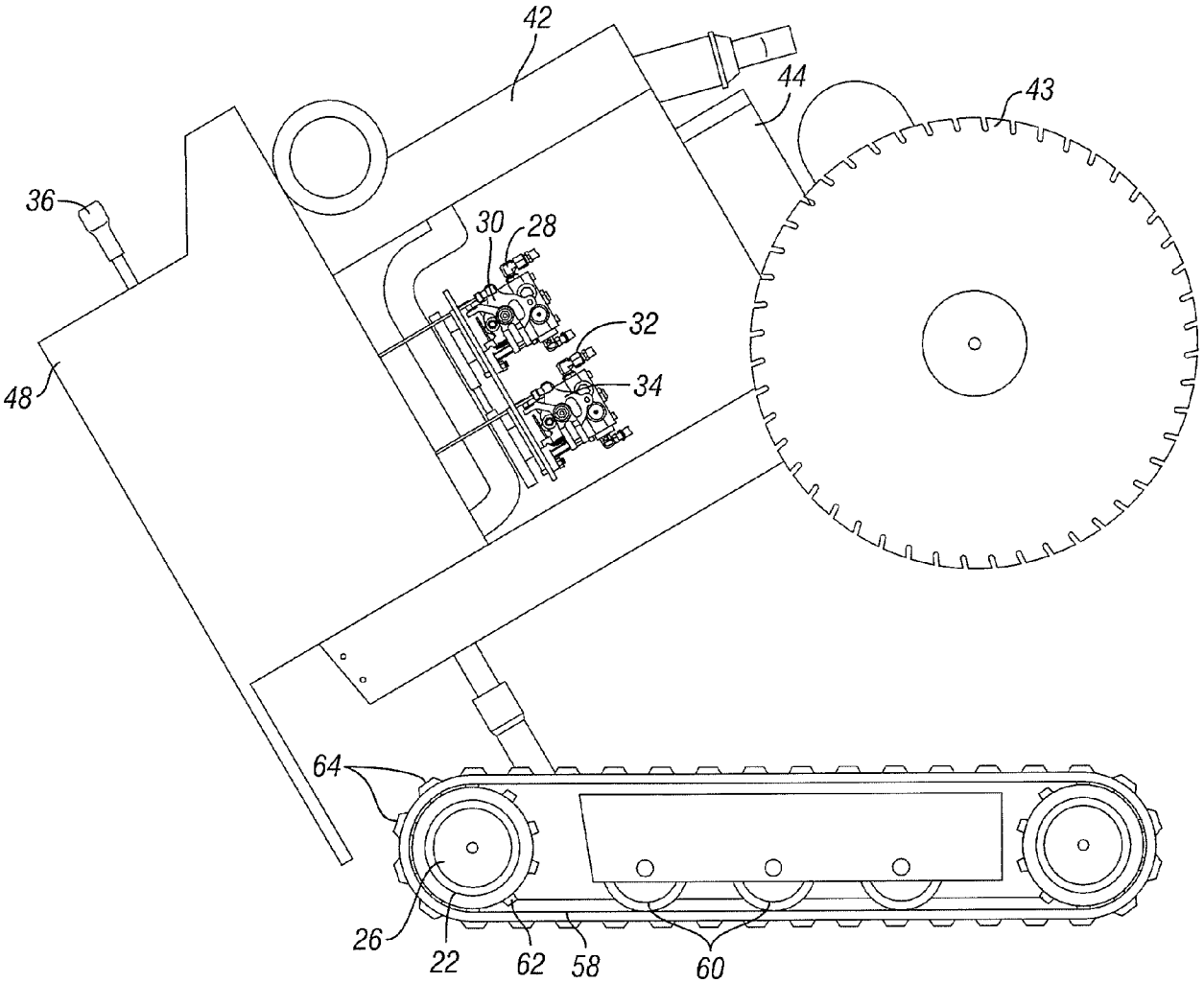
Figure 5:
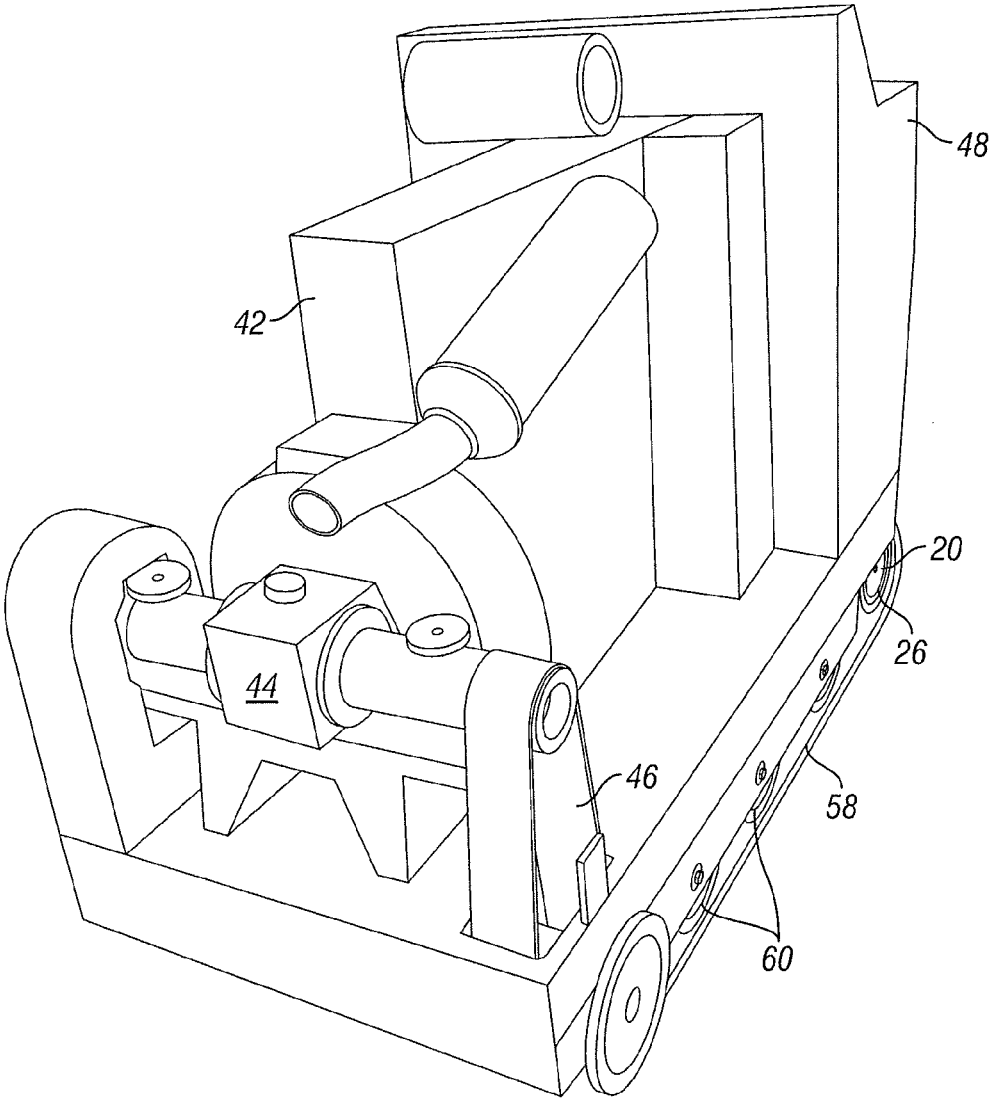
FIG. 5 is a front perspective view of the example slab saw shown in FIG. 4.

As shown, the engine 42 is mounted in-line with a transverse gear box 44 that cooperates with a belt 46 (FIG. 5) that drives the arbor, which in turn, rotates the saw blade 43. One skilled in the art should appreciate that a wide variety of saw blade types, sizes and configurations could be used with the saw 10 and this disclosure is not intended to be limited to a particular size, type or configuration. One skilled in the art should appreciate that the saw blade 43 could be raised/lowered using a variety of mechanisms. For example, the saw 10 could include one or more hydraulic cylinders that move the saw blade 43 between the raised/lowered positions. Embodiments are contemplated in which the components that are carried by the tracks 20, 22 could be pivotally mounted so that the hydraulic cylinder separates these components from the tracks in the raised position as shown in FIG. 4B. The engine 42 is shown diagrammatically because any engine or motor, mounted in-line or transversely, could be used that is configured to drive the pumps 28, 32 and the saw blade 42. The invention is not intended to be limited by the type or configuration of engine or motor, hydraulic, electric, gas or diesel.

In the example shown, the rear 12 of the saw 10 includes a cowl 48 with an instrument panel 50 showing various operating parameters of the saw 10. As shown, the cowl includes an access opening 52 for accessing various hydraulics and other components for maintenance and/or servicing. In the embodiment shown in FIG. 3A, a platform 54 extends from the rear 12 of the saw 10 for the operator to stand during operation. In another embodiment shown in FIG. 3B, a seat 56 extends from the rear of the saw 10 for the operator to sit during operation of the saw 10. Embodiments are also contemplated in which the operator could walk behind the saw during use.

Figure 6:
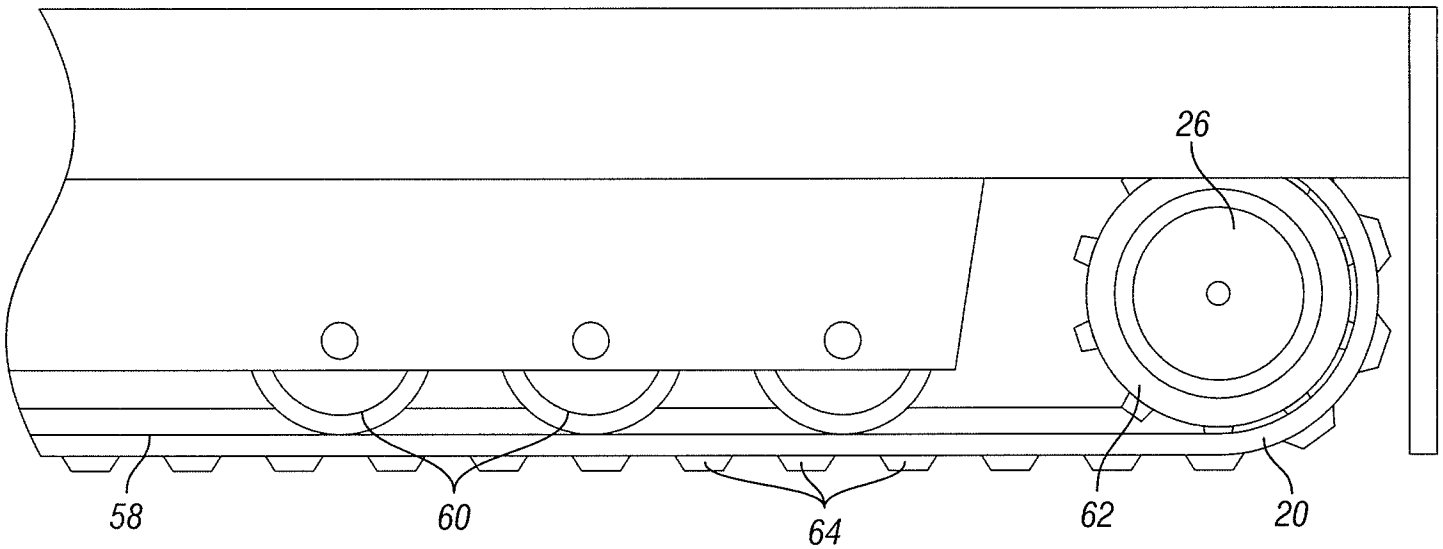
FIG. 6 is a detailed partial view of a portion of a track that could be used with the slab saw according to an embodiment of the present invention.

Referring to FIG. 6, this shows an example portion of a continuous track 58, such as the first track 20 and/or the second track 22, which may be used to propel the saw 10. In example shown, the track 58 is formed from a plurality of links (or rubber conveyor-type tracks) that surround a plurality of rollers 60 and a drive sprocket 62 operatively coupled with the motor 24, 26. The drive sprocket 62 engages interior notches in the track 58 to propel the track 58 in either a forward or a rearward direction via a motor 24, 26. The outer surface of the track 58 may include a tread 64 that increases traction. As discussed above, a motor 24, 26 may be used to drive the drive sprocket 62 based on the control of the hydrostatic pumps 28, 32.

Figure 7:
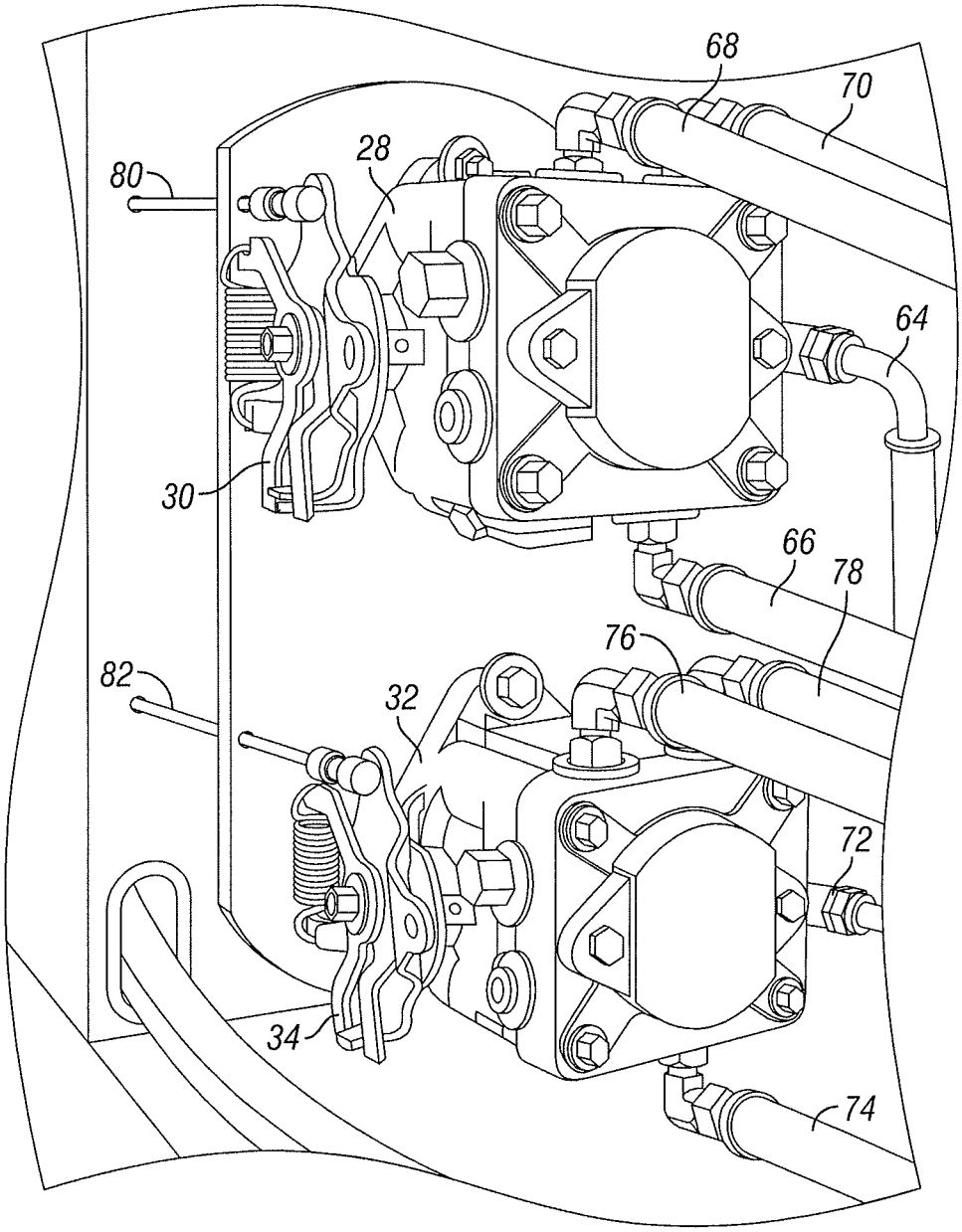
FIG. 7 is a right side perspective view of example hydrostatic pumps that could be used for controlling the motors that propel the tracks according to one embodiment of the present invention.

Referring to FIG. 7, there is shown a detailed view of the pumps 28, 32 with the valve assemblies 30, 34 in a neutral position. In this example, the first pump 28 has an inlet 64, an outlet 66, a feed line 68, and a return line 70. Likewise, the second pump 32 includes an inlet 72, an outlet 74, a feed line 76, and a return line 78. The inlets 64, 72 draw hydraulic fluid from a reservoir, which would be positioned within the cowl 48, and circulates through the outlets 66, 74. The pressure of the hydraulic fluid could be displayed on a gauge on the instrument panel 50. The feed line 68 and return line 70 are in fluid communication with the first hydraulic motor 24; the feed line 68 and return line 70 control the direction of flow and thus the direction of the first hydraulic motor 24. Likewise, the feed line 76 and return line 78 are in fluid communication with the second hydraulic motor 26; the feed line 76 and return line 78 control the direction of flow and thus the direction of the second hydraulic motor 26. Further, a pressure equalization valve may be connected to each of the feed lines 68, 76 and lever 36 so as to equalize, when appropriate, a pressure differential between the feed lines 68 and 76.

An end of a first control cable 80 is connected with the first valve assembly 30 and an end of a second control cable 82 is connected with the second valve assembly 34. As discussed below, the opposing ends of the cables 80, 82 are connected with the control assembly so that the lever 36 can independently move the cables 80, 82 to independently control the valve assemblies 30, 34, which allow the motors 24, 26 to be independently driven using the lever 36 (or other control/steering mechanism).

Figure 8:
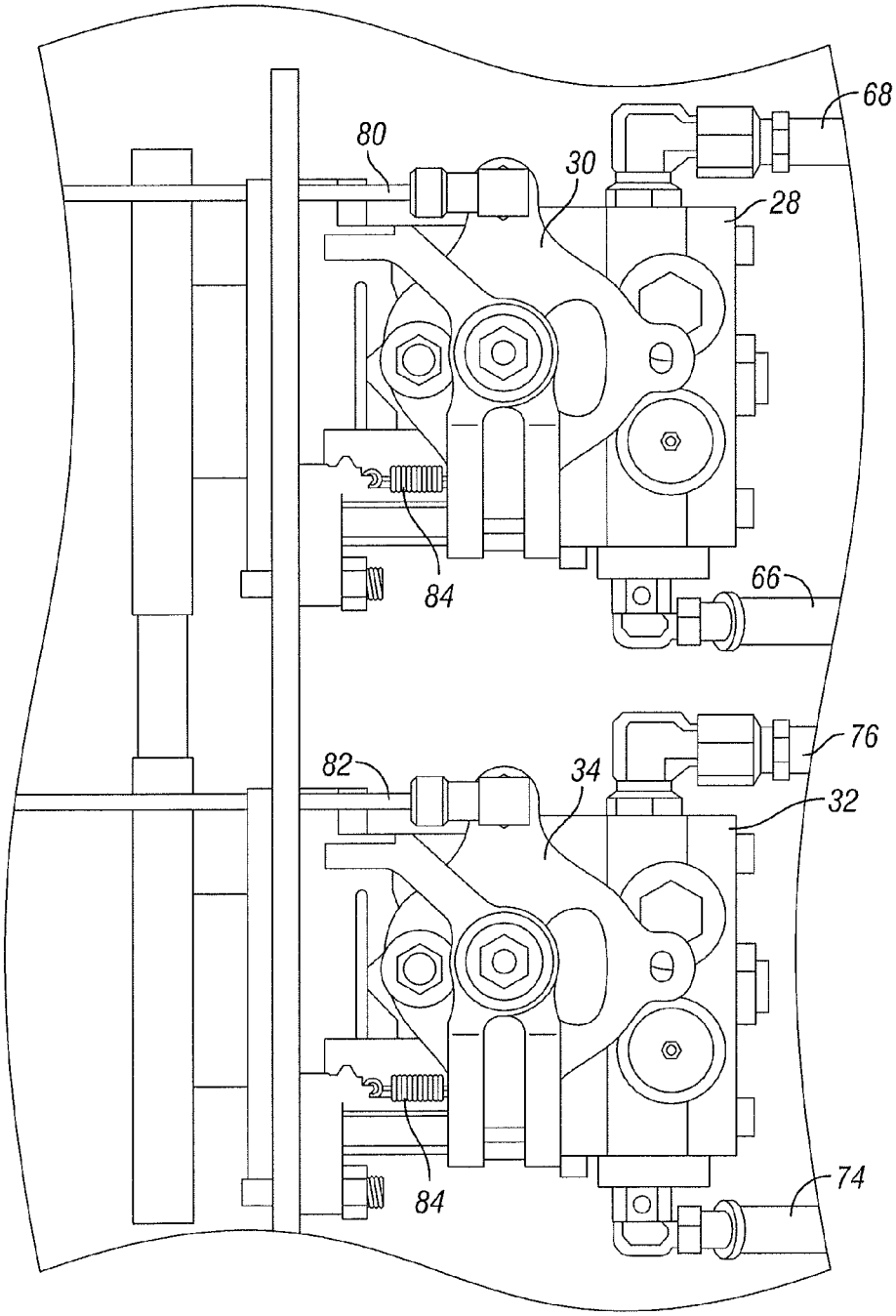
FIG. 8 is a right side view of the example hydrostatic pumps shown in FIG. 7 with the valve assemblies of both pumps in the neutral position.

FIG. 8 shows the valve assemblies 30, 34 in a neutral position, which is a position in which the motors 24, 26 are not driven. Each of the valve assemblies 30, 34 include a biasing member 84 that urges the respective valve assemblies 30, 34 into the neutral position.

Figure 9:
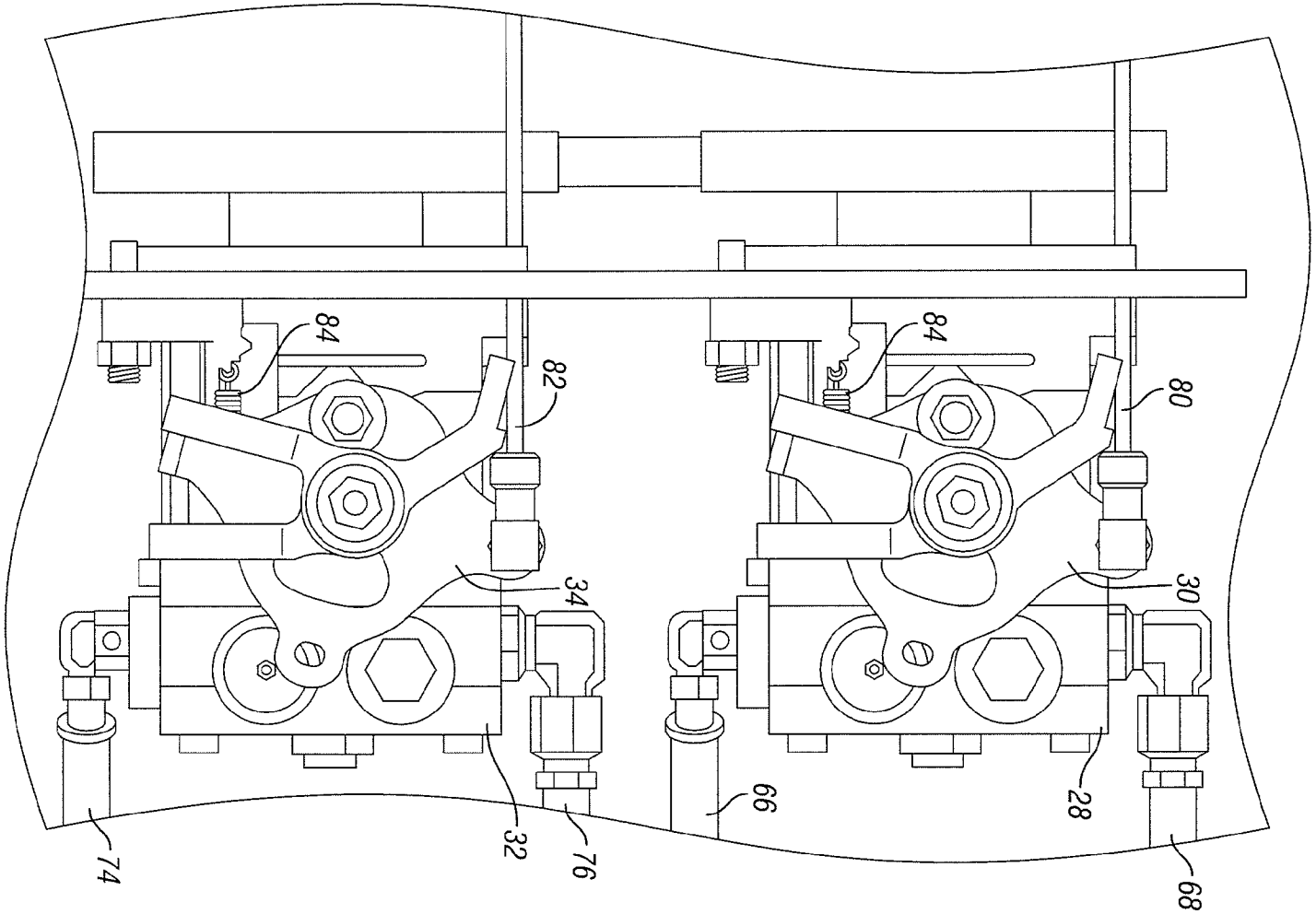
FIG. 9 is the example hydrostatic pumps shown in FIG. 8 with the valve assemblies of both pumps in the forward position.

FIG. 9 shows both of the valve assemblies 30, 34 in a forward position. The valve assemblies 30, 34 have moved to the forward position due to movement of the control cables 80, 82 based on the operator's movement of the lever 36 in the direction of arrow 38. When both valve assemblies 30, 34 are in this position, the hydraulic fluid flows through the feed lines 68, 76 to the motors 24, 26, which causes rotation to propel the saw 10 forward.

Figure 10:
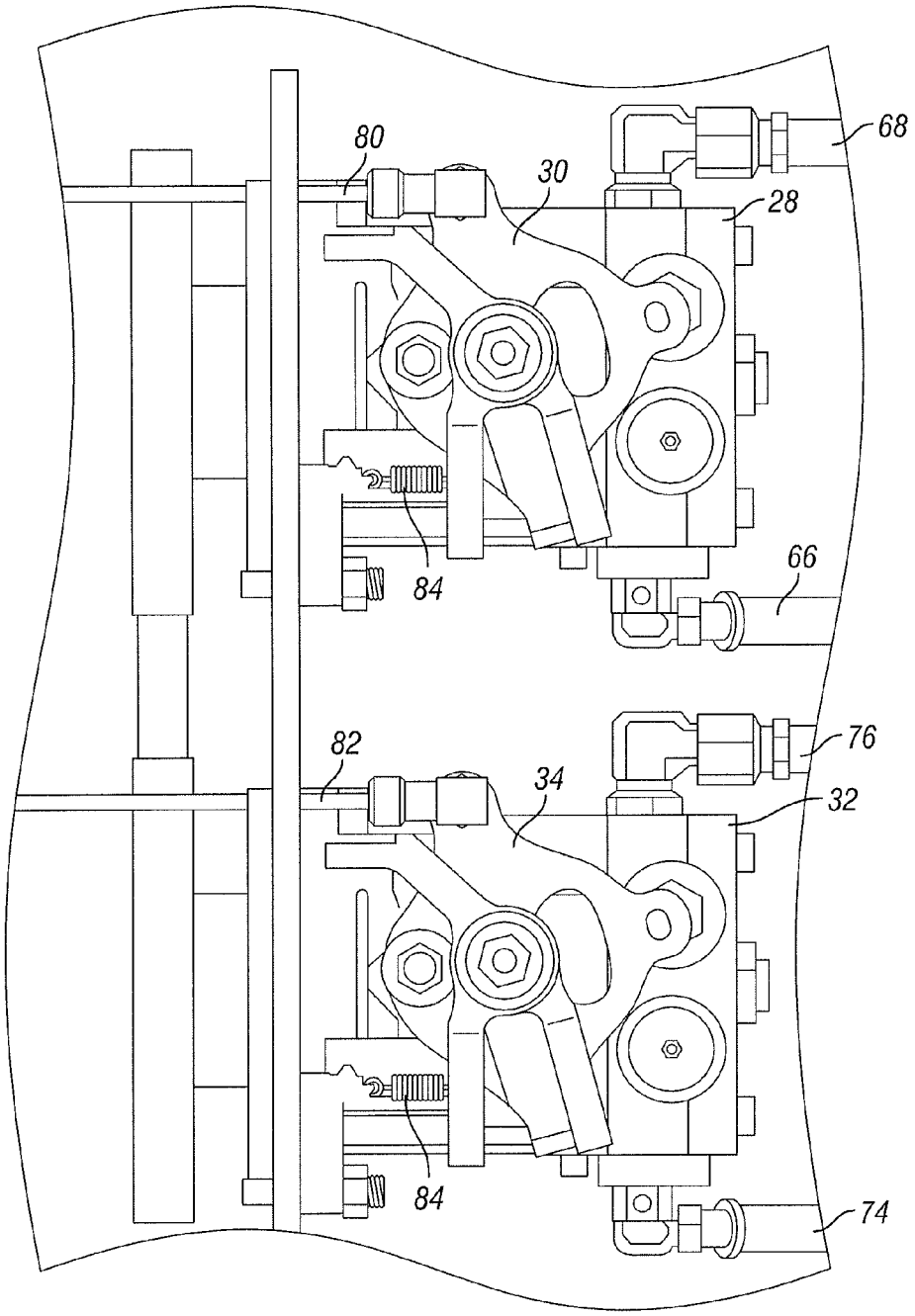
FIG. 10 is the example hydrostatic pumps shown in FIG. 8 with the valve assemblies of both pumps in the reverse position.

FIG. 10 shows both of the valve assemblies 30, 34 in a reverse position. The valve assemblies 30, 34 have moved to the reverse position due to movement of the control cables 80, 82 based on the operator's movement of the lever 36 in the direction of arrow 40. When both valve assemblies 30, 34 are in this position, the hydraulic fluid flows through the return lines 70, 78 to the motors 24, 26, which causes rotation to propel the saw 10 in reverse.

Figure 11:
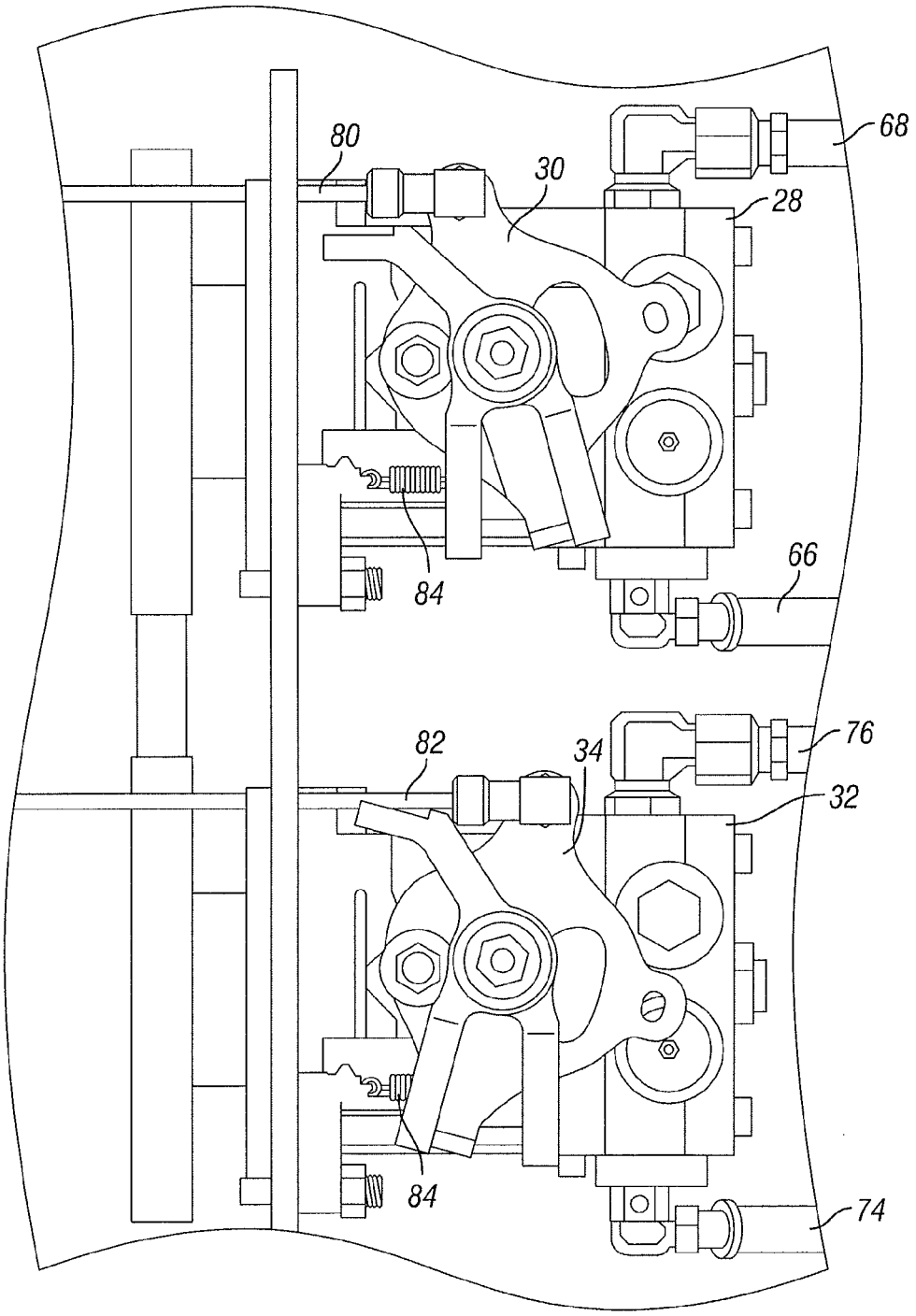
FIG. 11 is the example hydrostatic pumps shown in FIG. 8 with the first valve assemblies in the reverse position and the second valve assembly in the forward position.

FIG. 11 shows the first valve assembly 30 in the reverse position and the second valve assembly 34 in the forward position, which causes the saw 10 to steer toward the left. The valve assemblies 30, 34 have moved to the reverse and forward positions, respectively, due to movement of the control cables 80, 82 based on the operator's movement of the lever 36 in the direction of arrow 38 and twisting in the lever counter-clockwise direction.

Figure 12:
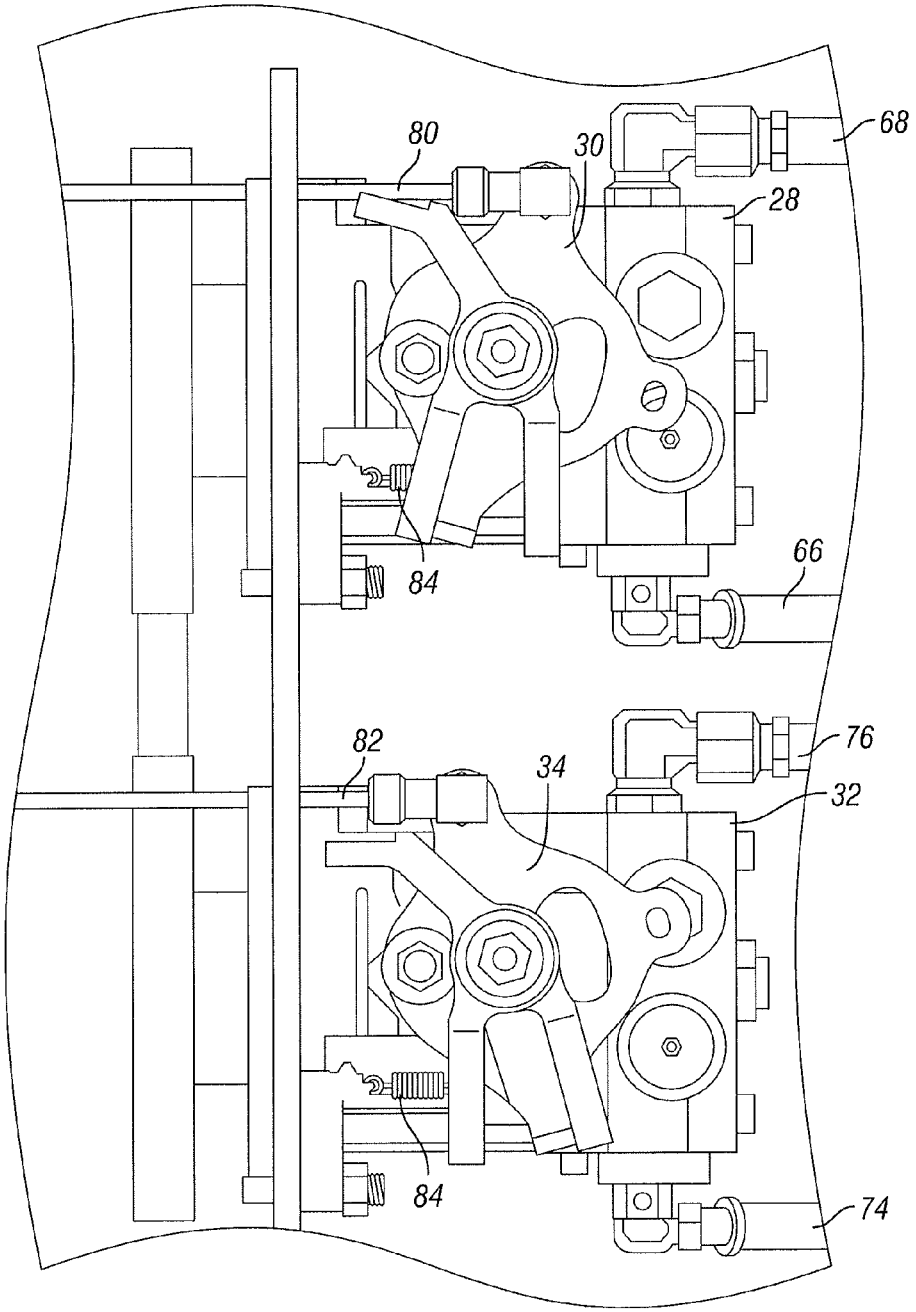
FIG. 12 is the example hydrostatic pumps shown in FIG. 8 with the first valve assemblies in the forward position and the second valve assembly in the reverse position.

FIG. 12 shows the first valve assembly 30 in the forward position and the second valve assembly 34 in the reverse position, which causes the saw 10 to steer toward the right. The valve assemblies 30, 34 have moved to the forward and reverse positions, respectively, due to movement of the control cables 80, 82 based on the operator's movement of the lever 36 in the direction of arrow 38 and twisting in the lever clockwise direction.

Figure 13:
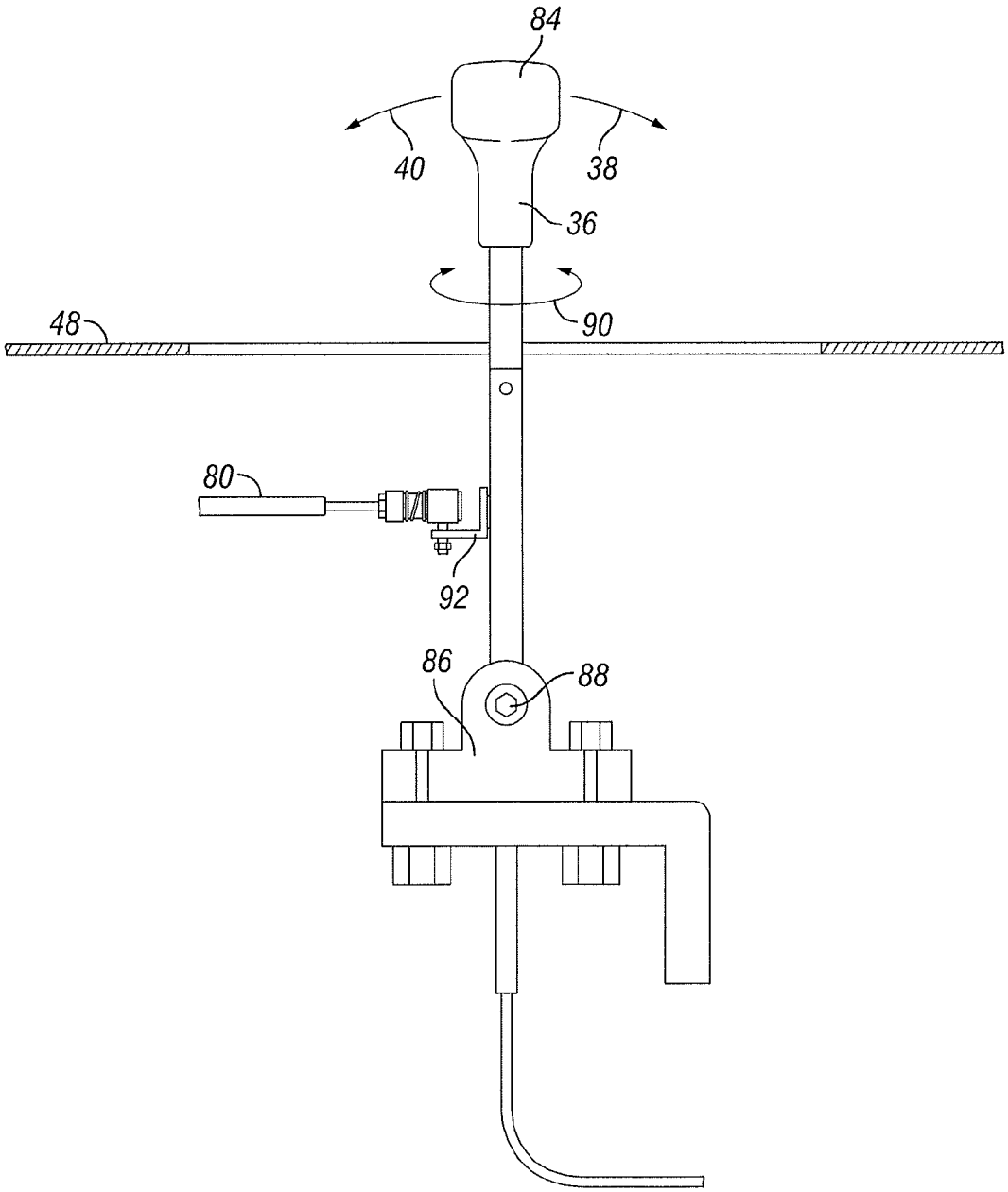
FIG. 13 is a side cross-sectional view of the control assembly with the lever in a neutral position according to one embodiment of the present invention.
Figure 14:
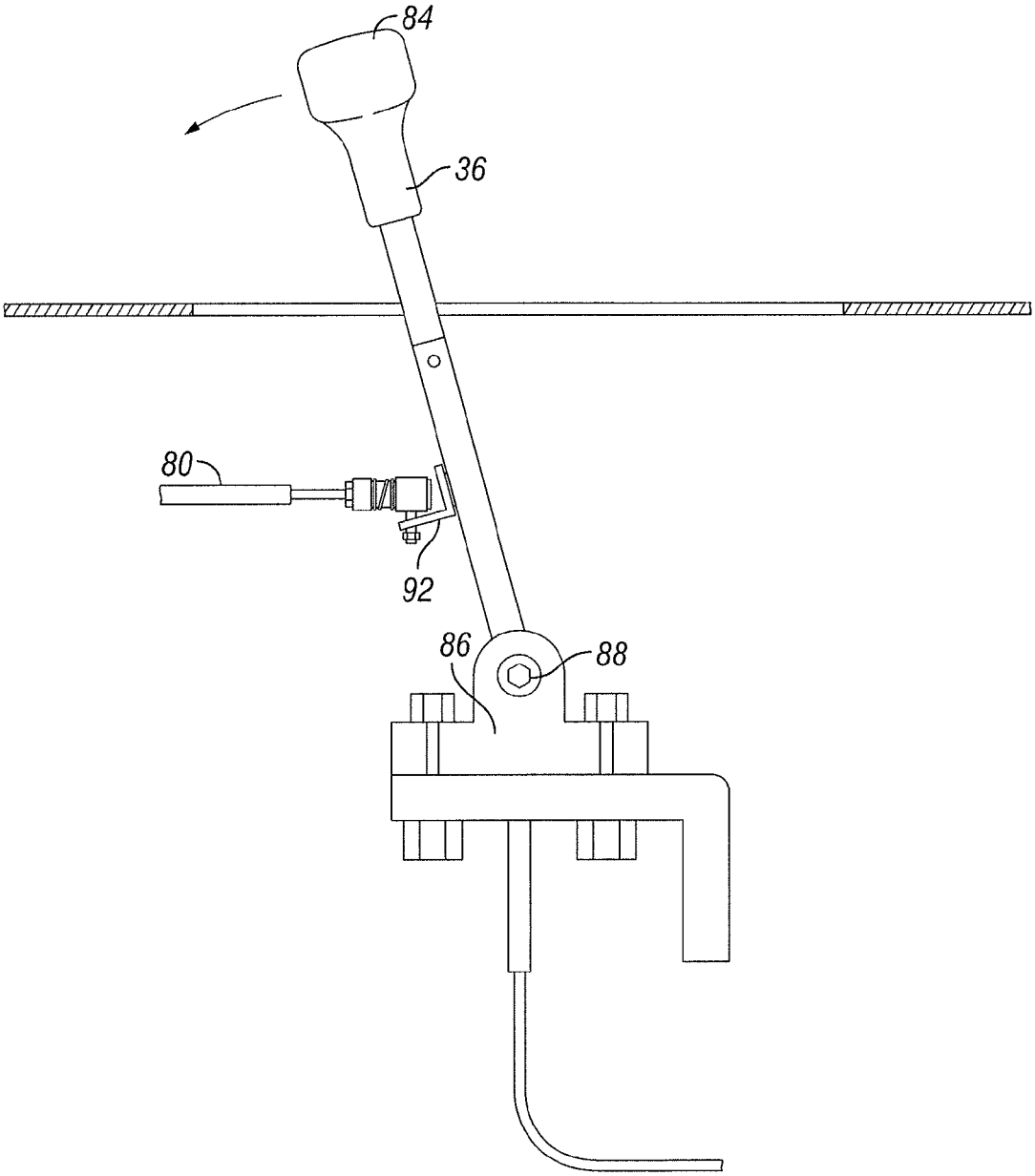
FIG. 14 is the control assembly shown in FIG. 13 in the forward position.
Figure 15:
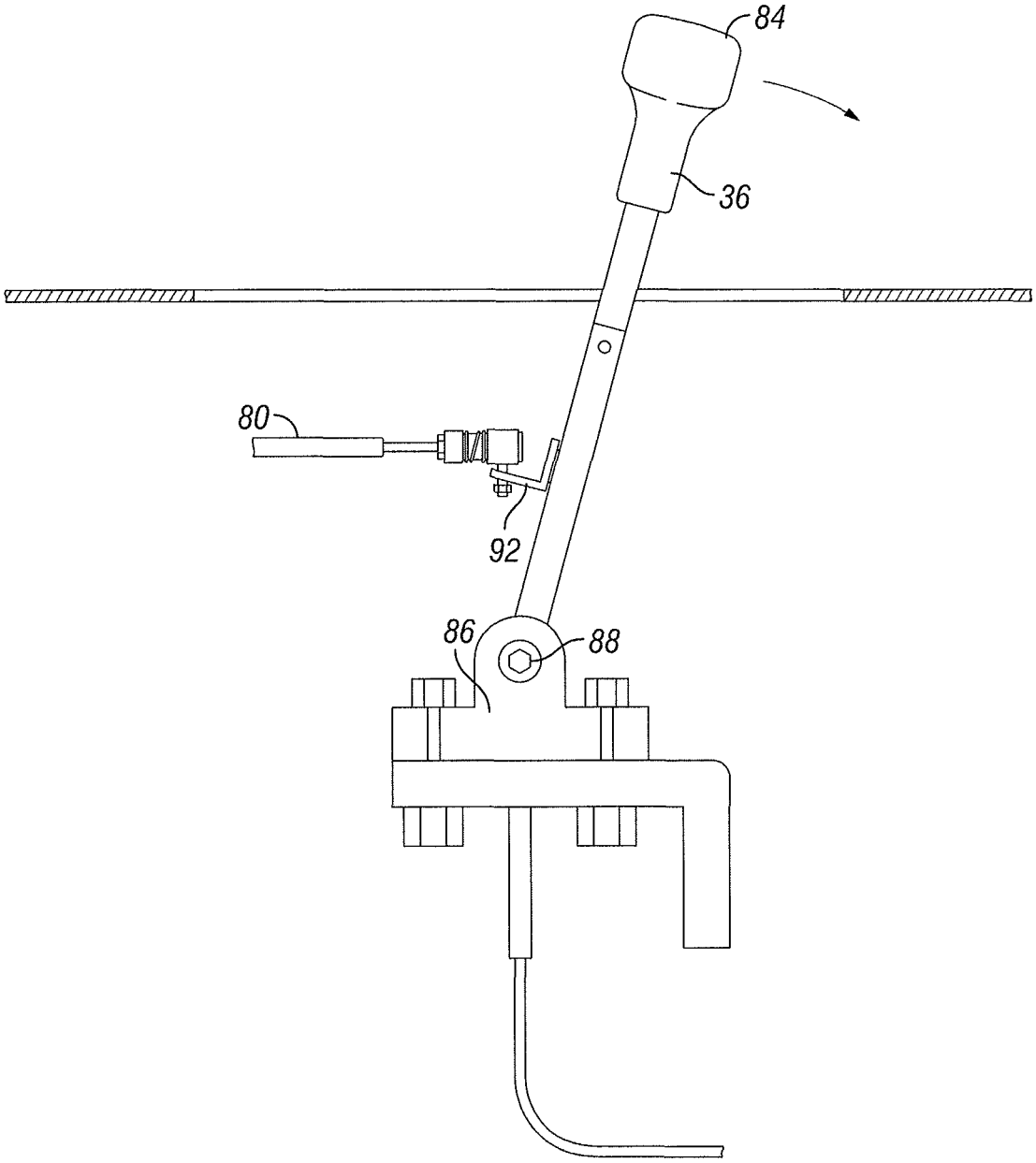
FIG. 15 is the control assembly shown in FIG. 13 in the reverse position.
Figure 16:
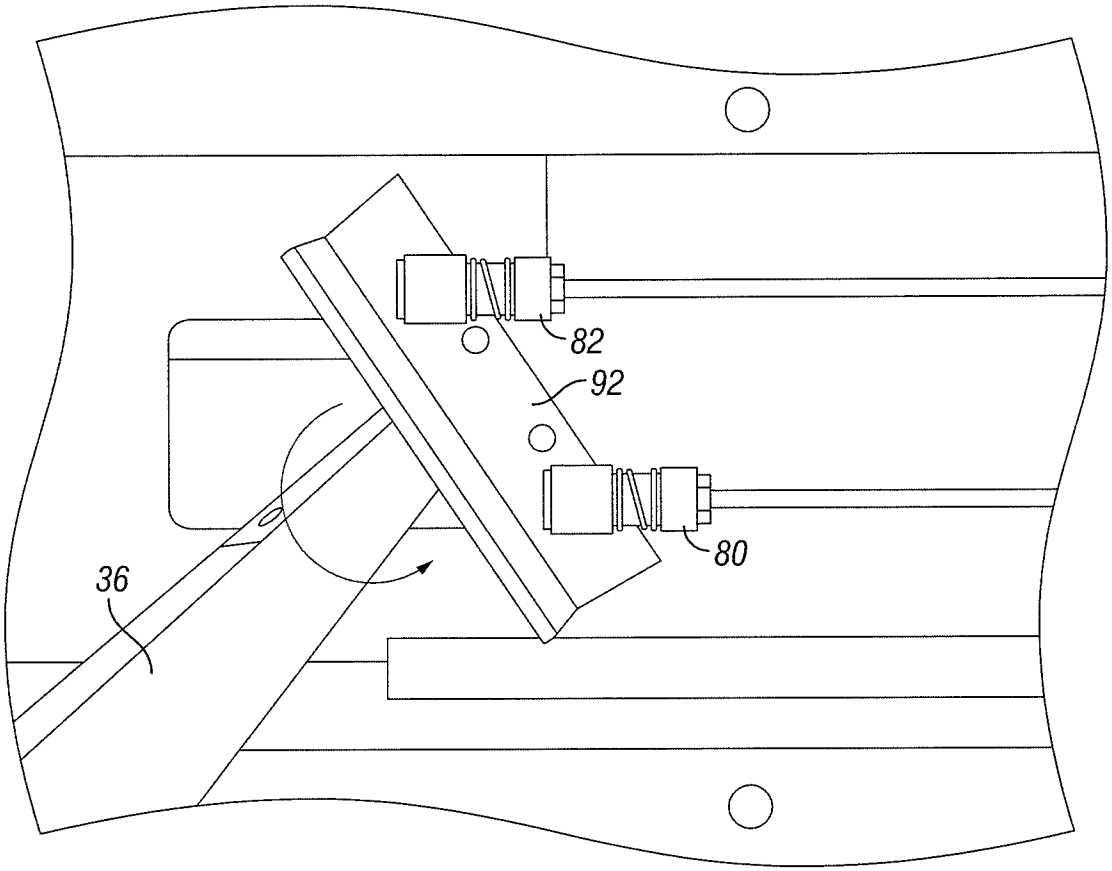
FIG. 16 is a top view of the control assembly showing the lever and control cables rotated in a counter-clockwise position.
Figure 17:
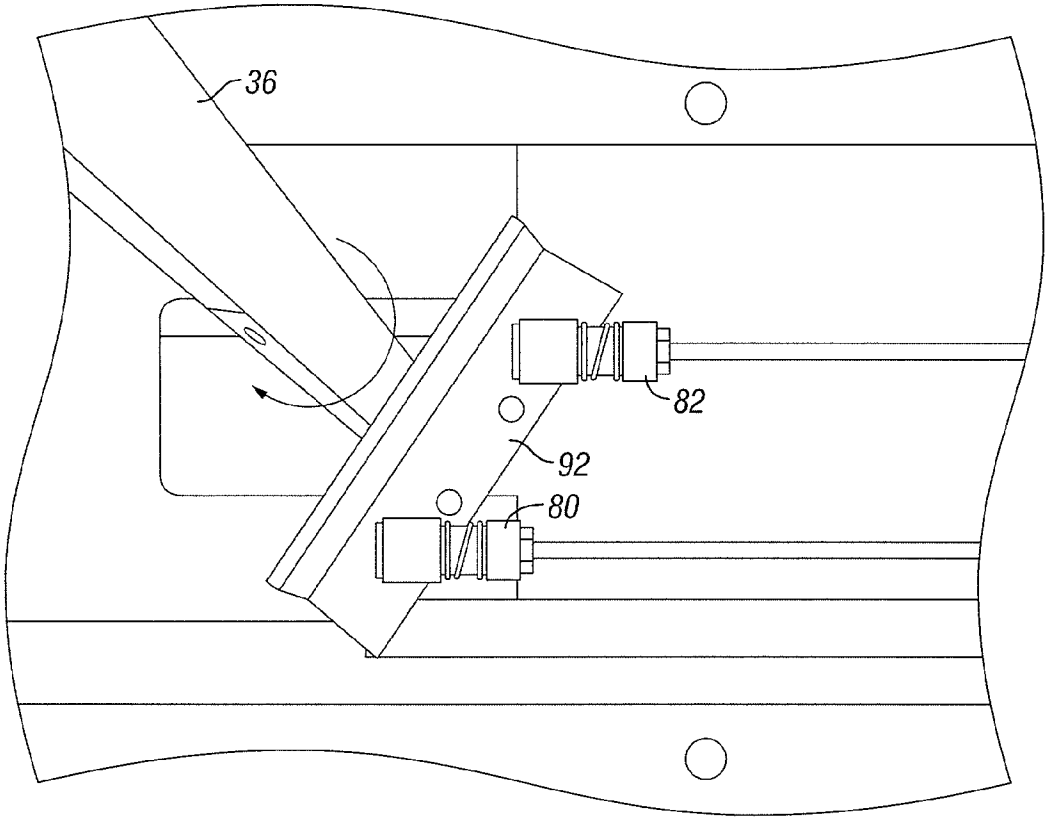
FIG. 17 is a top view of the control assembly showing the lever and control cables rotated in a clockwise position.

FIGS. 13-17 show an embodiment of the control assembly. In this embodiment, the lever 36 has a handle 84 on one end a second end pivotably mounted to a frame 86. In the example shown, the second end of the lever 36 rotates about a pivot point 88. The lever 36 is also configured to twist in the clockwise or counterclockwise direction as shown by arrow 90. An end of the control cables 80, 82 are mounted to the lever 36 using a bracket 92 in the example shown. This means that movement of the lever 36 causes concomitant movement of the control cables 80, 82. FIG. 13 shows the control assembly in the neutral position in which the saw 10 is not being propelled. FIG. 14 shows the control assembly in the forward position, which propels the saw 10 in the reverse direction based on movement of the valve assemblies 30, 34 as discussed above. FIG. 15 shows the control assembly in the reverse position, which propels the saw 10 forward based on movement of the valve assemblies 30, 34 as discussed above. FIG. 16 shows the control assembly twisted in a counterclockwise manner to steer to the left. FIG. 17 shows the control assembly twisted in a clockwise manner to steer to the right.

In operation, the operator will use the lever 36 to propel the saw 10 forward or in reverse. In this embodiment, the operator will be able to steer the saw 10 left or right by twisting the lever 36 in a counter-clockwise or clockwise direction. This will allow the operator to stand on the platform 54 or a seat 56 and maneuver the saw 10 solely using the lever 36, without needing to exert physical force on the saw 10 itself to maintain the saw blade 44 along the intended cut path.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A slab saw comprising:

a frame;

an engine supported by the frame;

an arbor configured to receive a saw blade and be rotatably driven by the engine;

a first track and a second track disposed along opposing sides of the frame, wherein the first track and the second track are configured to propel the frame;

a drive assembly configured to independently drive the first track with respect to the second track to propel the slab saw;

a control assembly configured to control the drive assembly as to a speed and direction of the slab saw; and wherein an axis about which the saw blade rotates is fixed with respect to the frame.

2. The slab saw of claim 1, wherein the drive assembly includes:

a first motor configured to drive the first track, but not the second track; and a second motor configured to drive the second track, but not the first track.

3. The slab saw of claim 2, wherein the first motor and the second motor are hydraulic motors.

4. The slab saw of claim 3, wherein the drive assembly includes:

a first pump configured to control a speed of the first motor; and a second pump configured to control a speed of the second motor.

5. The slab saw of claim 4, wherein the first pump comprises a hydrostatic pump.

6. The slab saw of claim 4, wherein the first pump includes a first valve and the second pump includes a second valve, wherein the control assembly is configured to independently adjust positions of the first valve and the second valve.

7. The slab saw of claim 6, wherein the control assembly includes a first cable attached to the first valve and a second cable attached to the second valve.

8. The slab saw of claim 7, wherein the control assembly is configured to independently move the first cable and the second cable.

9. The slab saw of claim 3, wherein the drive assembly includes:

a first pump configured to control a direction of the first motor; and a second pump configured to control a direction of the second motor.

10. The slab saw of claim 1, further comprising a seat attached to the frame for supporting an operator during operation of the slab saw.

11. The slab saw of claim 1, further comprising a platform extending from the frame that is dimensioned for an operator to stand during operation.

12. The slab saw of claim 1, wherein the frame is configured to pivot with respect to the first track and/or the second track.

13. The slab saw of claim 1, wherein the saw blade rotates in a plane that is fixed with respect to a longitudinal axis of the first track and/or the second track.

14. The slab saw of claim 13, wherein the plane is approximately parallel to the longitudinal axis of the first track and/or the second track.

15. A slab saw comprising:

a frame;

an engine supported by the frame;

an arbor configured to receive a saw blade and be rotatably driven by the engine;

a first track and a second track disposed along opposing sides of the frame, wherein the first track and the second track are configured to propel the frame;

means for independently driving the first track with respect to the second track;

means for steering the slab saw by applying a speed differential between the first track and the second track; and wherein an axis about which the saw blade rotates is fixed with respect to the frame.

16. The slab saw of claim 15, wherein the driving means includes a hydraulic transmission configured to independently drive the first track with respect to the second track.

17. The slab saw of claim 15, wherein the driving means includes:

a first motor configured to drive the first track, but not the second track; and a second motor configured to drive the second track, but not the first track.

18. The slab saw of claim 17, wherein the drive assembly includes:

a first pump configured to control a speed of the first motor; and a second pump configured to control a speed of the second motor.

19. The slab saw of claim 18, wherein the first pump includes a first valve and the second pump includes a second valve, wherein the control assembly is configured to independently adjust positions of the first valve and the second valve.

20. A method for operating a slab saw, the method comprising the steps of:

providing a track-driven slab saw with a frame and having a first track and a second track, wherein the track-driven slab saw includes a rotatable saw blade, wherein an axis about which the saw blade rotates is fixed with respect to the frame;

independently driving the first track with respect to the second track to propel the slab saw, the first track and the second track being disposed along opposite sides of the slab saw; and steering the slab saw by applying a speed differential between the first and second tracks.

21. The method of claim 20, wherein the slab saw includes:

a first motor that drives the first track, but not the second track; and a second motor that drives the second track, but not the first track.

22. The method of claim 21, wherein the slab saw includes:

a first pump configured to control a speed of the first motor, the first pump including a first valve; and a second pump configured to control a speed of the second motor, the second pump including a second valve.

23. The method of claim 22, wherein the step of applying the speed differential is performed by independently adjusting positions of the first valve and the second valve.

* * * * *